US006341755B1

(12) United States Patent
Kump

(10) Patent No.: US 6,341,755 B1
(45) Date of Patent: Jan. 29, 2002

(54) SHELF TOP ADAPTER

(75) Inventor: Daniel J. Kump, Gates Mills, OH (US)

(73) Assignee: Fasteners For Retail, Inc., Cleveland, OH (US)

( * ) Notice: Subject to any disclaimer, the term of this patent is extended or adjusted under 35 U.S.C. 154(b) by 0 days.

(21) Appl. No.: 09/316,424

(22) Filed: May 21, 1999

Related U.S. Application Data

(63) Continuation-in-part of application No. 09/261,874, filed on Mar. 3, 1999, and a continuation-in-part of application No. 29/099,852, filed on Jan. 29, 1999, now Pat. No. Des. 425,134, and a continuation-in-part of application No. 29/099,516, filed on Jan. 22, 1999, now Pat. No. Des. 424,121, and a continuation-in-part of application No. 09/078,164, filed on May 13, 1998, now Pat. No. 6,082,687, and a continuation-in-part of application No. 09/054,064, filed on Apr. 2, 1998, now abandoned.

(60) Provisional application No. 60/084,854, filed on May 8, 1998.

(51) Int. Cl.[7] ..... A47B 96/06

(52) U.S. Cl. ..... 248/220.41; 248/222.51

(58) Field of Search ..... 248/220.31, 220.41, 248/220.42, 221.11, 221.12, 222.11, 222.13, 222.12; 211/57.1, 54.1, 113, 118, 59.1; 40/642.01, 651, 657

(56) References Cited

U.S. PATENT DOCUMENTS

| | | | | | |
|---|---|---|---|---|---|
| 3,452,954 | A | * | 7/1969 | Lucietto | 248/220.22 |
| 3,625,464 | A | * | 12/1971 | Conran | 248/222.13 |
| 4,319,731 | A | * | 3/1982 | Pfeifer | 248/223.4 |
| 4,619,428 | A | * | 10/1986 | Bailey | 248/222.13 |
| 4,995,182 | A | * | 2/1991 | Fast | 40/649 |
| 5,339,967 | A | * | 8/1994 | Valiulis | 248/220.41 |
| 5,346,166 | A | | 9/1994 | Valiulis | 248/220.4 |
| 5,415,370 | A | | 5/1995 | Valiulis | 248/220.4 |
| 5,636,937 | A | * | 6/1997 | Zemlicka | 248/222.11 |
| 5,678,699 | A | * | 10/1997 | Gebka | 211/57.1 |
| 5,678,795 | A | | 10/1997 | Henry et al. | 248/220.41 |
| 5,683,003 | A | | 11/1997 | Gebka | 211/57.1 |
| 5,722,625 | A | | 3/1998 | Kenney | 248/220.41 |
| 5,887,731 | A | * | 3/1999 | Thalenfeld | 248/222.51 |
| 5,908,119 | A | * | 6/1999 | Kump et al. | 211/113 |
| 6,082,687 | A | * | 7/2000 | Kump et al. | 248/220.41 |

OTHER PUBLICATIONS

"Fasteners for retail" product brochure dated 4/98 cover page, back page and pages 20, 37, 38, 43 and 97.

* cited by examiner

*Primary Examiner*—Anita King
*Assistant Examiner*—Gwendolyn Baxter
(74) *Attorney, Agent, or Firm*—Fay, Sharpe, Fagan, Minnich & McKee, LLP

(57) ABSTRACT

A shelf top adapter (A, B, C) includes a planar plate member (10, 10', 110) which lies adjacent an upper surface of a shelf (30) or display fixture. The plate is held snugly in contact with the shelf by a rearward pair of feet (14, 14', 114), which extend downward and axially from a rear edge (18) of the plate member, and a pair of forward mounting fingers (16, 80, 116) which extend downward from the plate member forward of the feet. The forward mounting fingers may be in the form of pegs (80) or hooks (16, 116), the hooks each including a fin (36, 136) extending laterally to the planar member. The feet and forward mounting fingers are inserted through suitably placed apertures (26, 32) in the shelf. The adapter is resistant to accidental removal during use, while being readily attached to, or removed from the shelf when desired. A label mounting member (50, 50', 150) on a forward end (46, 46', 148) of the plate member, extends forwardly from the shelf for displaying pricing labels, small items of merchandise, or the like.

17 Claims, 4 Drawing Sheets

SHELF TOP ADAPTER

This application claims the priority of U.S. Provisional Application Ser. No. 60/084,854, filed May 8, 1998, and is a Continuation-in-Part of U.S. patent application Ser. No. 09/078,164, filed May 13, 1998 now U.S. Pat 6,082,687; U.S. patent application Ser. No. 09/054,064, filed Apr. 2, 1998; Design Patent Application Ser. No. 29/099,516, filed Jan. 22, 1999, now U.S. Design Pat. No. 0,424,121 filed May 2, 2000; Design Patent Application Ser. No. 29/099,852, filed Jan. 29, 1999 now U.S. Design Pat. No. 425,134, filed May 16, 2000; and U.S. patent application Ser. No. 09/261,874, filed Mar. 3, 1999.

BACKGROUND OF THE INVENTION

The present invention relates generally to merchandising systems employed in retail stores. More particularly, it relates to an improved shelf top adapter for use with display racks and shelves employed in retail stores for displaying merchandise. The adapter enables labels with prices and other information to be displayed adjacent the merchandise held on the display racks and shelves.

Businesses use a wide variety of devices to display products and sale prices to consumers. One of the known ways to display products in a retail environment involves the use of horizontally oriented display shelves. Information about the products is often displayed on label or flag holders which are mounted on a forward end of the shelf or display rack for ease of visibility by consumers. Since the prices of products and the products displayed on the shelves tend to change periodically, such holders are usually removable from the shelf or display rack or adaptable to changing a sign or label gripped by the holder.

U.S. Pat. Nos. 5,346,166; 5,678,795; 5,683,003; and 5,722,625 disclose examples of holders which are mounted to a horizontal shelf surface and display labels or small packages of merchandise. For example, U.S. Pat. No. 5,683,003 shows a label holder with a transparent label cover which enables the label holder to carry adhesive or non-adhesive labels. A foot and post mounting provides cantilever support for the label holder. A disadvantage of this device is that the label is not easily removable. The label cover must be removed from the device in order to allow removal of a label. Another disadvantage of this and other shelf mounted devices is that they are not securely secured to the shelf in a sturdy manner. Thus, they may be dislodged from the shelf when knocked accidentally.

Accordingly, it has been considered desirable to develop a new and improved shelf top adapter which overcomes the foregoing difficulties and others while providing better and more advantageous overall results.

BRIEF SUMMARY OF THE INVENTION

In accordance with one embodiment of the present invention, a shelf top adapter is provided. The adapter includes a planar support member. Spaced rearward mounting fingers extend away from a rear edge of the support member for selectively engaging suitably shaped and positioned rearward apertures in an associated fixture. Spaced forward mounting fingers extend away from the support member forward of the rearward fingers, for selectively engaging suitably shaped and positioned forward apertures in an associated fixture. A display member is mounted on a forward end of the support member.

In accordance with more limited aspects of this embodiment of the present invention, the rearward mounting fingers extend rearwardly from the planar support member for engaging a lower surface of the associated fixture adjacent the rearward apertures. The forward mounting fingers may comprise pegs. Alternatively, the forward mounting fingers may include laterally extending flexible fins, which preferably include camming surfaces for camming against edges of the forward apertures such that the forward fingers flex inward to allow the forward fingers to pass through the forward apertures. A rigid support wall is preferably connected with the planar support member and the display member. The display member may include a label mounting plate, which is attached to the forward end of the planar support member, and is angled upwardly for ease of viewing from above, or extends downward for sidewards display of labels. An adhesive layer is optionally provided on the display member for attaching a label, and a peelable strip is removable prior to attaching the label. Alternatively, a label holder, such as a resiliently flexible transparent sheet which has been folded to form a channel, is attached to a front face of the label mounting plate for selectively receiving a label. A package hook optionally extends from a lower end of the label mounting plate for displaying packages of merchandise.

In accordance with another embodiment of the present invention, a shelf top adapter is provided. The adapter includes a support member having a rear edge and first and second side edges which together form a pair of spaced rear corners. At least two spaced rearward feet extend downward and rearward from a respective one of the rear corners of the support member for selectively engaging suitably shaped and positioned rearward apertures in an associated fixture. A forward mounting finger extends downward and laterally from each of the support member first and second side edges forward of the rearward feet, for selectively engaging suitably shaped and positioned forward apertures in an associated fixture. A display member extends from the support member forward of the forward mounting fingers.

In accordance with yet another embodiment of the present invention, a shelf top adapter is provided. The adapter includes a support member having a rear edge and first and second side edges. At least one foot extends downward and rearward from the rear edge of the support member adjacent the first side edge of the support member for selectively engaging a suitably shaped and positioned rearward aperture in an associated fixture. At least one forward hook extends downward and laterally from adjacent the second side edge of the support member forward of the rear edge, for selectively engaging a suitably shaped and positioned forward aperture in an associated fixture. A display member extends from the support member forward of the hook.

In accordance with a further embodiment of the present invention, a method of supporting a display member on a shelf is provided. The method includes angling a support member adjacent an upper surface of the shelf, the display member being connected with a forward end of the support member. The method further includes inserting a pair of spaced rearward feet of the support member into suitably positioned rearward apertures in the shelf such that an upward facing surface of each of the feet engages a lower surface of the shelf and pivoting the forward end of the support member until a pair of spaced forward mounting fingers are received in suitably positioned forward apertures in the shelf.

In accordance with a more limited aspect of this embodiment of the present invention, the forward mounting fingers are hooks, each having a laterally extending resiliently flexible fin and the method further includes camming each of the fins against an outer edge of one of the forward apertures such that the fin flexes and the hook enters the aperture.

One advantage of the present invention is the provision of a new and improved shelf top adapter with spaced rearward and spaced forward mounting fingers which resist accidental dislodging of the adapter from an associated shelf.

Another advantage of the present invention is the provision of a shelf top adapter in which the forward mounting fingers comprise hooks with resiliently flexible fins which flex to allow the hooks to enter suitably placed apertures in the shelf and then return to an unflexed position in which an upper surface of each fin engages a lower surface of the shelf.

Still another advantage of the present invention is the provision of a display member with a label mounting plate, which is angled upwardly for ease of viewing from above.

Yet another advantage of the present invention is the provision of a display member which extends downward for sidewards display of labels. The display member may also have one or more hooks for holding merchandising strips of the type known in the art.

Still other benefits and advantages of the present invention will become apparent to those skilled in the art upon a reading and understanding of the following detailed specification.

BRIEF DESCRIPTION OF THE DRAWINGS

The invention takes form in certain parts and arrangements of parts, preferred embodiments of which will be described in detail in this specification and illustrated in the accompanying drawings which form a part hereof and wherein.

DETAILED DESCRIPTION OF THE PREFERRED EMBODIMENTS

Figure 1:
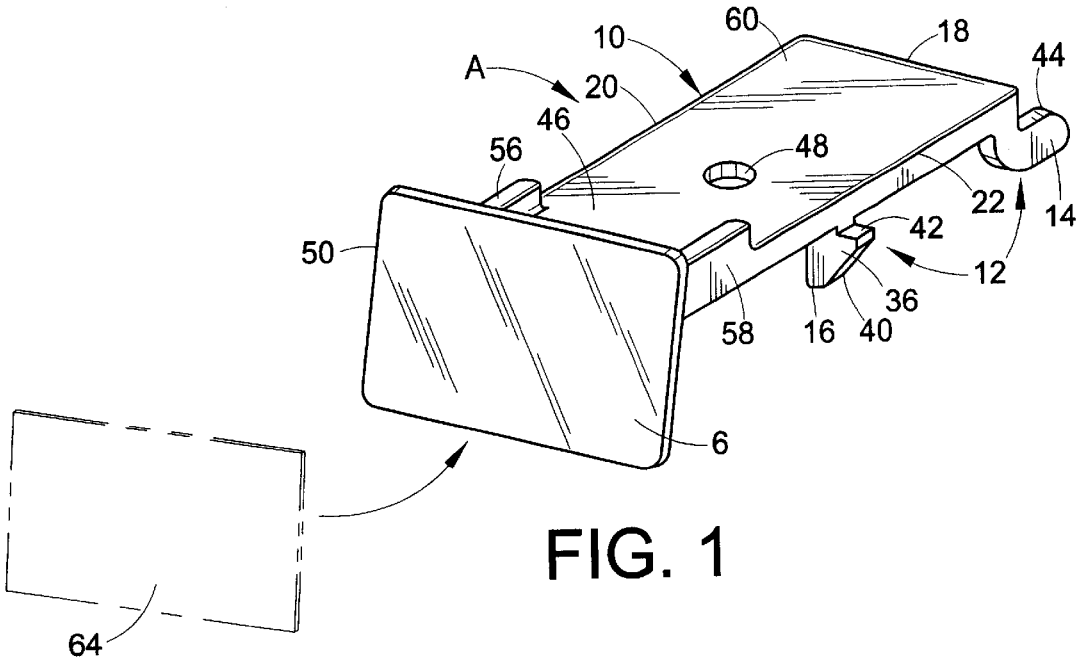
FIG. 1 is a perspective view of a shelf top adapter according to a first preferred embodiment of the present invention.

Referring now to the drawings, wherein the showings are for purposes of illustrating the preferred embodiments of the invention only and are not for purposes of limiting same, FIG. 1 shows a shelf top adapter A according to a first preferred embodiment of the present invention. The shelf top adapter of this and other embodiments is preferably molded from a relatively rigid, but resiliently yielding plastic, such as polypropylene of course, other types of conventional plastic materials can also be used. As will be described in greater detail herein, the shelf top adapter can have a variety of configurations for displaying labels in different orientations. The shelf top adapters of the present invention are all configured for attachment to a rigid support, such as a horizontal shelf having vertically extending apertures therein.

Figure 2:
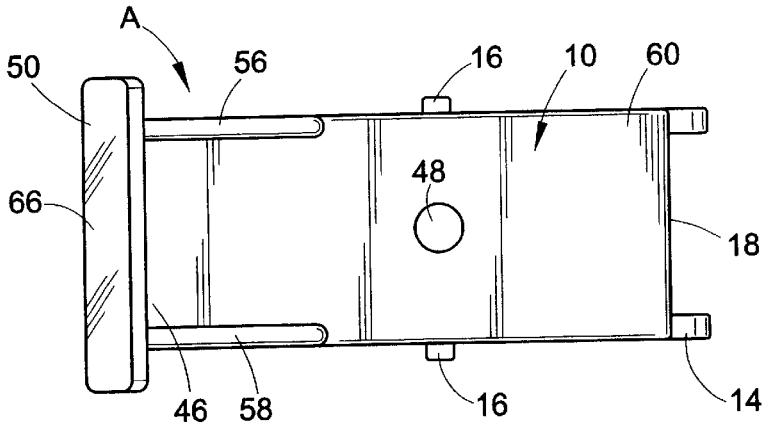
FIG. 2 is a top plan view of the shelf top adapter of FIG. 1.
Figure 3:
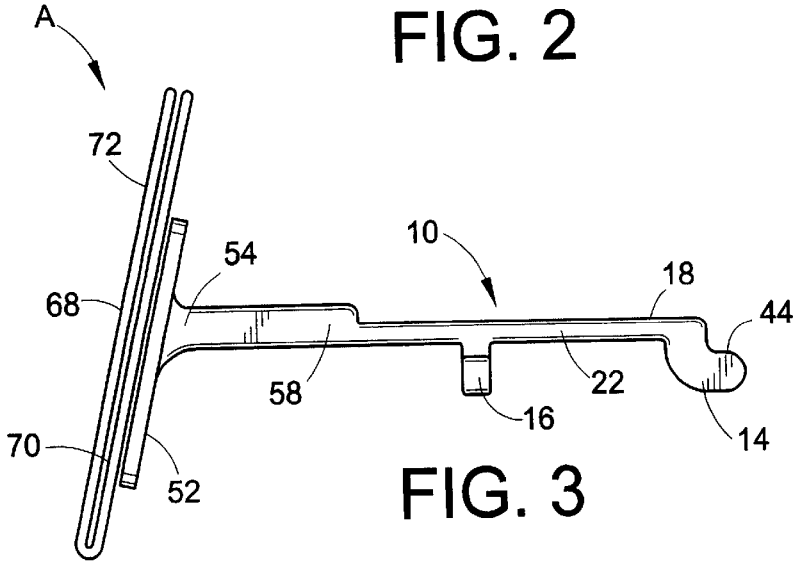
FIG. 3 is a side elevational view of the shelf top adapter of FIG. 4 holding a first type of label mounting means.
Figure 4:
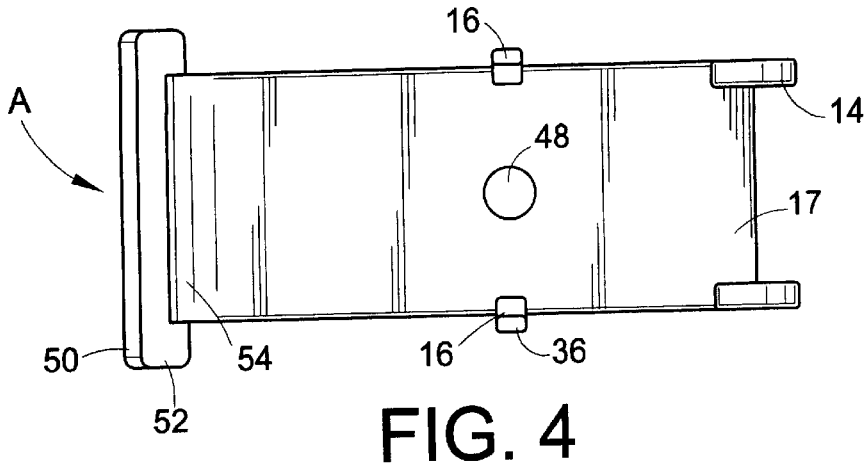
FIG. 4 is bottom plan view of the shelf top adapter of FIG. 1.

In the embodiment of FIG. 1, the shelf top adapter A includes a generally rectangular, horizontal plate member 10, adapted to fit against an upper surface of the shelf. With reference also to FIGS. 2–4, mounting fingers or protrusions 12 for the plate member 10 preferably include a rearward pair of feet 14 and a forward pair of hooks 16. These extend generally downwardly and radially outwardly from a lower surface 17 of the plate member 10, and are preferably formed integrally with the plate member. As shown in FIG. 1, the feet 14 depend from a rear edge 18 of the plate adjacent opposed side edges 20 and 22 and extend rearwardly beyond the rear edge of the plate. The hooks 16 depend from the plate adjacent a mid point of the side edges 20 and 22 and extend transversely beyond the side edges on either side of the plate. The adapter could include more than two feet by using a wider plate. Also, if the plate were longer, more than one hook on each side could be provided.

Figure 5:
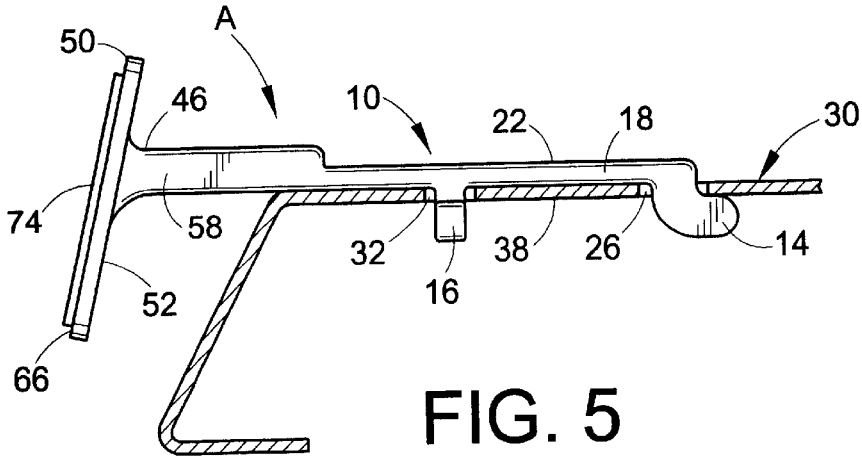
FIG. 5 is a side elevational view of the shelf top adapter of FIG. 1 holding a second type of label mounting means.

With reference also to FIG. 5, the rearward pair of feet 14 are dimensioned to be received into a selected spaced pair of rearward apertures 26 in a second row of apertures in a shelf 30. The pair of hooks 16 snap into a corresponding pair of forward apertures 32 in a first row of apertures in the shelf 30.

To insert the shelf top adapter into apertures 26, 32 in the shelf 30, the plate member 10 is held at a slight angle from the horizontal and the rearward feet 14 are slid into the two spaced rearward apertures 26 in the second row of apertures to position the shelf top adapter A on the shelf 30. The plate member is then brought into a horizontal orientation and the forward hooks 16 snapped into the two forward apertures 32 in the first row of apertures on the shelf.

The hooks 16 preferably include laterally extending fins 36 which tend to grip a lower surface 38 of the shelf, restricting upward movement of the plate member 10. Specifically, the fins each include a camming surface 40 which engages an outer edge of the aperture 32 as the hooks are snapped into position. This pushes the resilient hook inwards so that the hook can pass through the aperture. Once the fin 36 is below the lower surface 38 of the shelf, the resilient hook springs outward and an upper surface 42 of the fin engages the lower surface of the shelf. This provides the adapter with a firm grip on the shelf to resist accidental removal of the adapter. Similarly, the feet 14 each include a flat upper surface 44 which engages the lower surface of the shelf. The feet and hooks 14 and 16 provide a simple means of supporting the plate member 10 in a generally horizontal position on the shelf 30 without the need for screws or other fixing means. The combined positioning of the feet (adjacent opposite corners of the rear edge 18) and hooks (on opposite side edges 20 and 22, and longitudinally spaced from the feet) provide four points of stability which resist displacement of the adapter A from the shelf due to a force being applied to the adapter from the front, rear, or sides. The adapter can thus withstand accidental knocks from any direction and angle without being dislodged from the shelf.

Of course, with sufficient upwardly-directed force at the front end of the plate 10 on the bottom surface 17 thereof, the adapter can be detached from the shelf by reversing the attachment process mentioned above.

While a combination of feet and hooks provides both lateral and axial support by contact with the underside 38 of the shelf, other embodiments are also contemplated. For example, the fingers 12 could comprise both rear and forward hooks. In this embodiment, the fins of the rear hooks would extend axially, while the forward fins would continue to extend laterally (i.e. the rear pair facing rearwardly and the forward pair facing sideways), or combinations of the above.

Due to the resilient material from which the bracket A is made, the plate member 10 can be disengaged from the shelf 30 by lifting up on a front end 46 of the plate member 10 until the hooks 16 snap out of the forward apertures 32 and then lifting the plate member forwardly and upwardly to release the feet 14. In use, the front end 46 extends forwardly of the shelf 30, as shown in FIG. 5.

With continued reference to FIGS. 1 and 2, the plate member 10 optionally includes a securing aperture 48 in addition to the feet 14 and hooks 16, for attaching the plate member to the shelf 30. The securing aperture 48 is positioned generally centrally on the plate member, between the two hooks 16, and extends vertically through the plate member. A conventional clip, screw, or other suitable fixing member, passes through the securing aperture and a suitably positioned aperture in the shelf 30. For example, the aperture can be one of the apertures 32 in the first row of apertures. Depending on the location of the securing aperture, the shelf aperture could also be positioned between the forward and rearward apertures, to attach the adapter A to an upper surface of the shelf. The clip provides another means for securing the plate member 10 to a shelf.

A label mounting member 50 in the form of a generally rectangular plate is attached at a rear face 52 thereof to a forward edge 54 of the plate member 10. Support walls 56 and 58 extend generally vertically from an upper horizontal surface 60 of the plate member adjacent the side edges 20 and 22 at the front end 46 of the plate, and are integrally molded with the label mounting member So and the front end. The support walls 56 and 58 extend to, and are connected with, the rear face 52 of the label mounting member 50 and provide rigidity to a front end of the shelf top adapter A. The support walls support the label mounting member 50 and resist angular movement of the label mounting member relative to the plate member 10.

The label mounting member may be used in a number of ways. In one embodiment, shown in FIG. 1, a label, such as an adhesively backed label 64, is attached to a front face 66 of the label mounting member.

Alternatively, as shown in FIG. 3, a transparent label holder 68 is adhesively, or otherwise attached to the front face 66 of the label mounting member. The label holder comprises a resiliently flexible sheet of transparent plastic or similar material which is bent double to define a channel 70 for receiving a label. A cover portion 72 of the label holder can be flexed forwardly for ease of insertion or removal of the label. Of course, a label holder can also be formed from two different kinds of plastic materials where only the cover portion is transparent, whereas the base sheet is not. The two materials may be coextruded in the shape of the label holder. The size of the label holder can be selected according to the size of labels to be displayed. The adapter can thus be used for a variety of labels of different sizes.

Figure 6:
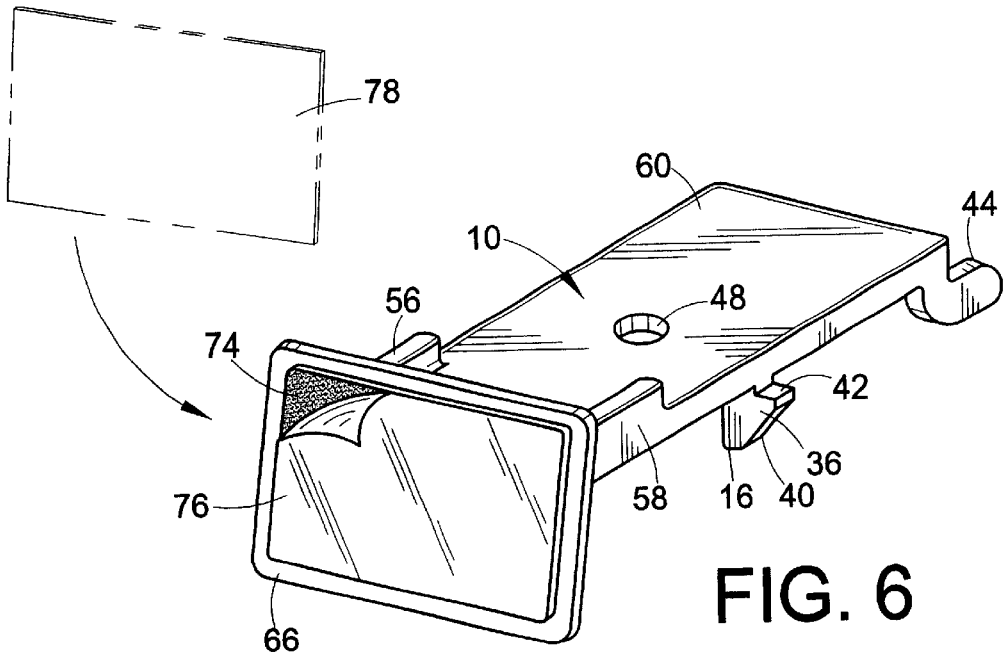
FIG. 6 is a perspective view of the shelf top adapter of FIG. 5.

Alternatively, as shown in FIGS. 5 and 6, a layer of adhesive 74 is provided on the front face 66 of the label mounting member, with a peelable strip 76 covering the adhesive. The strip 76 is removed prior to adhesively attaching a label 78.

The embodiments of FIGS. 1–6 are particularly suited to displaying labels on shelves below eye level as the front face 66 of the label mounting member is angled upward, towards a person viewing the shelf from above. Of course, for shelf top adapters mounted on shelves situated above a person's head, the label mounting member could alternatively be angled downwards, or even aligned with a vertical axis.

Figure 7:
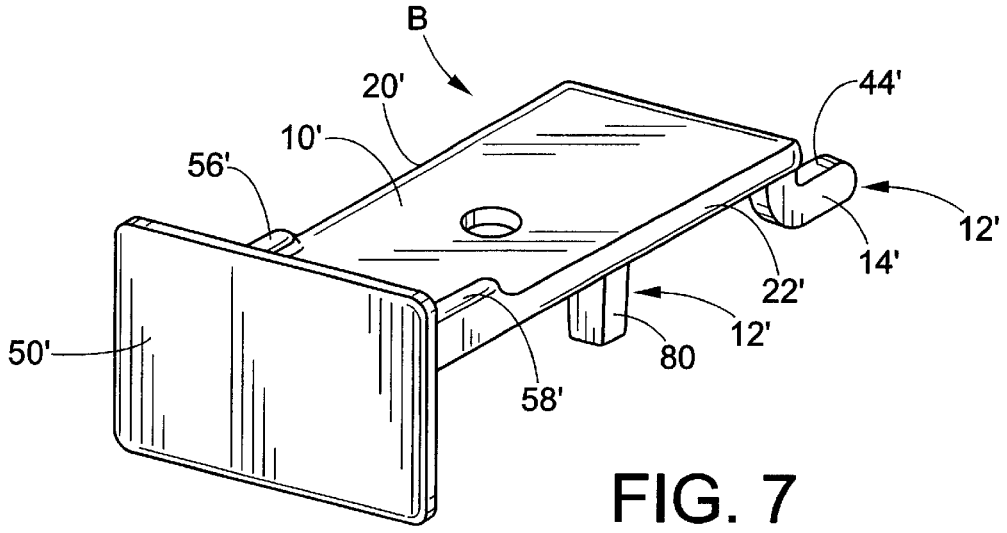
FIG. 7 is a perspective view of a shelf top adapter according to a second preferred embodiment of the present invention.
Figure 8:
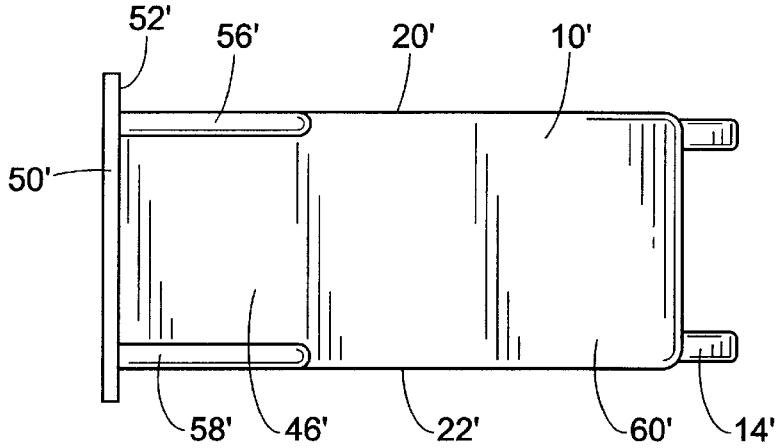
FIG. 8 is a top plan view of the shelf top adapter of FIG. 7.

With reference to FIGS. 7–8, a second preferred embodiment of a shelf top adapter B is thereshown. For ease of illustration and comprehension of this alternative, like components are identified with like numerals with a primed suffix (') and new components are identified by new numerals.

Figure 9:
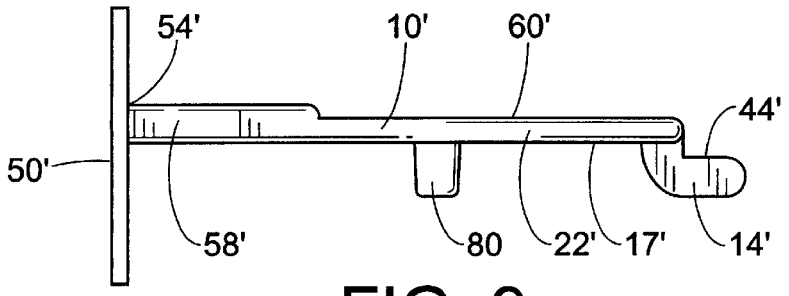
FIG. 9 is a side elevational view of the shelf top adapter of FIG. 7.

The adapter B is similar in configuration to the sign holder of FIGS. 1–6 in that a plate member 10' has mounting fingers 12' for attaching the adapter to a shelf 30. The mounting fingers of adapter B comprise rear feet 14' and forward pegs 80. The rear feet 14' extend downwardly and rearwardly from a lower surface 17' of the plate member 10' adjacent a rear edge 18' thereof. As shown in FIGS. 7 and 9, the forward pegs 80 depend from the plate adjacent a mid point of side edges 20' and 22'. The forward pegs may be cylindrically shaped or have four faces, as shown in FIGS. 7 and 9. The plate member 10' lacks a central aperture, although a central aperture of the type shown in embodiment A could, of course, be included.

As for the embodiment of FIGS. 1–6, the rearward pair of feet 14' are dimensioned to be received into a selected spaced pair of rearward apertures in a second row of apertures in a shelf 30 of the type shown in FIG. 5. The feet 14' each include a flat upper surface 44' which engages the lower surface of the shelf. The adapter B is inserted into the shelf in a similar manner to adapter A, except in that the forward pegs 80 are lowered, rather than snapped into the two forward apertures 32 in the first row of apertures on the shelf, following insertion of the rear feet 14' into the rearward apertures 26. Optionally, the pegs 80' are tapered inward towards their lower ends, as best shown in FIG. 9, so that they can be easily inserted into the shelf.

The feet and pegs 14' and 80' support the plate member 10 in a generally horizontal position on the shelf 30 without the need for screws or other fixing means. They resist displacement of the adapter B from the shelf due to a force being applied to the adapter from the rear or sides. Accidental upward knocks on the front end may partially displace the adapter B. However, the rear feet 14' tend to return the adapter to its original position on the shelf provided the knock is not too severe. Removal of the adapter B involves simply lifting up on a front end 46' of the plate member 10'. The pegs 80 slide out of the forward apertures 32. The plate member is then lifted forwardly and upwardly to release the feet 14'.

A label mounting member 50' is attached at a rear face 52' thereof to a forward edge 54' of the plate member 10'. Support walls 56' and 58' extend generally vertically from an upper horizontal surface 60' of the plate member adjacent the side edges 20' and 22' at a front end 46', as for the shelf top adapter A. As shown in FIG. 9, the mounting member 50' of adapter B is aligned vertically, although angled mounting members, as for adapter A, are also contemplated.

Figure 10:
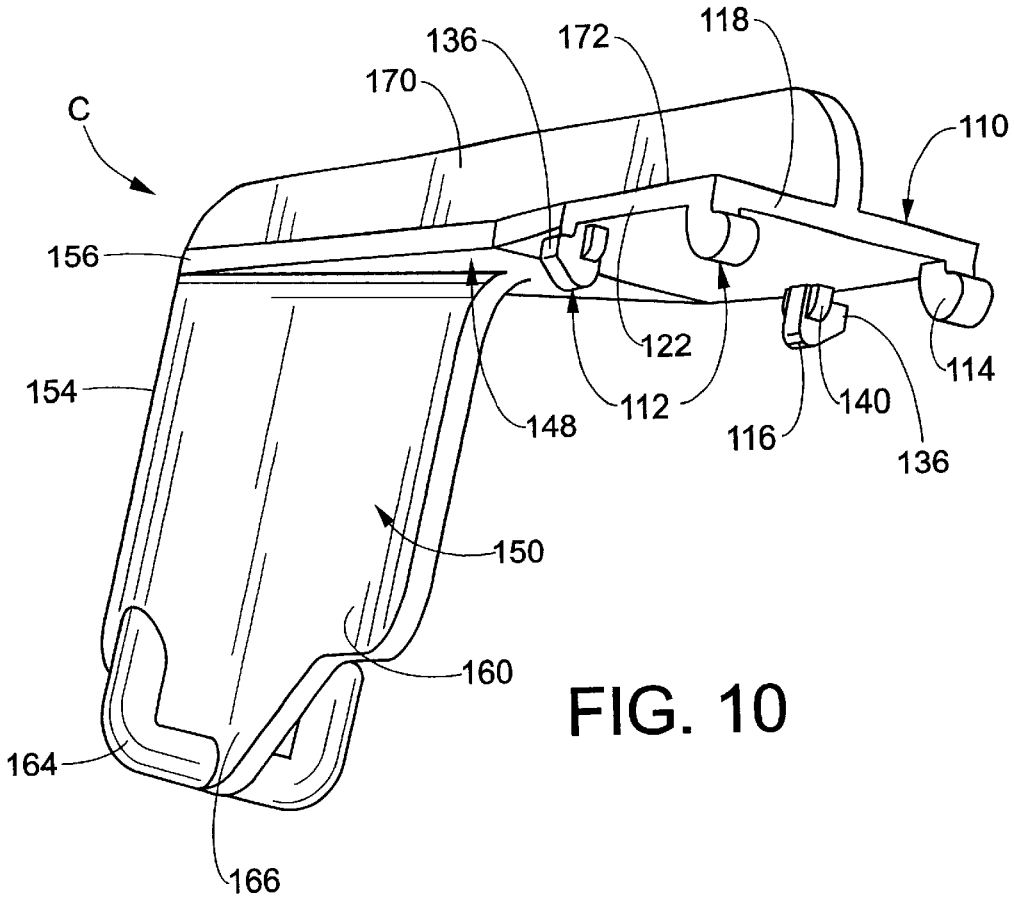
FIG. 10 is a rear perspective view of a shelf top adapter according to a third preferred embodiment of the present invention; and, FIG. 11 is a front perspective view of the shelf top adapter of FIG. 10.
Figure 11:
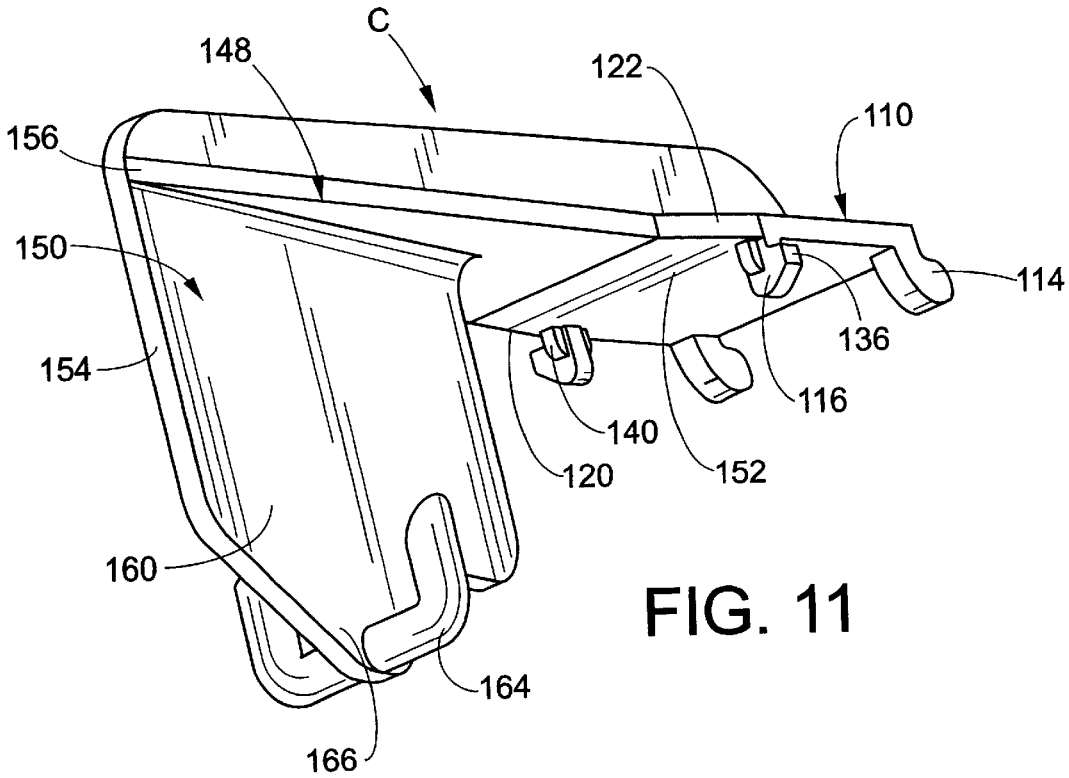

With reference to FIGS. 10–11, a third preferred embodiment of a shelf top adapter C is shown. The adapter C is similar in configuration to the sign holder of FIGS. 1–6 in that a plate member 110 has mounting fingers 112 comprising rear feet 114 and forward hooks 116. The fingers extend downwardly and outwardly from a lower surface 117 of the plate member for attaching the adapter to a shelf 30, of the type shown in FIG. 5. The plate member includes a rear edge 118 and side edges 120 and 122. In addition to axially extending fins 136, the hooks 116 may also include laterally extending projections 140, one of the projections on each hook facing forwardly and one facing rearwardly. The projections fit the shelf aperture snugly, gripping the periphery of the aperture. Optionally, the projections are tapered, such that they engage the aperture periphery primarily at their upper ends. Of course, such projections may also be included on the pegs 80 of adapter B or on the hooks 16 of adapter A.

A forward end 146 of the plate member 110 defines a tapering support portion 148 for supporting a side-facing label mounting plate 150. The support portion 148 extends forwardly of the shelf when in use and in the same plane as the rest of the plate 110.

As shown in FIGS. 10 and 11, the support portion 148 is triangular in shape, although other configurations are also contemplated. The triangular support portion is preferably integrally formed with the rest of the plate 110. Optionally, an intermediate portion 152 of the plate member which extends between the hooks 116 and the support portion is also inwardly tapered.

The label mounting plate 150 extends downwardly from a lower surface of the support portion 148, with a forward end 154 of the label mounting plate 150 positioned beneath an apex 156 of the triangular support portion. Labels, such as adhesively backed labels or adhesive-free labels may be attached to left and right side-facing surfaces 160 of the label mounting plate 150, as described for the shelf top adapter A.

In this embodiment, a pair of merchandise hooks 164 extend laterally from adjacent a lower end 166 of the label mounting plate for receiving and displaying small packets of merchandise thereon. The hooks can also hold merchandising strips which, in turn, hold packets of merchandise.

To provide rigidity, a support rib 170 preferably extends vertically from an upper surface 172 of the plate member 110. As shown in FIGS. 10 and 11, the support rib extends axially along the plate member from adjacent a midpoint of the rear edge 118 of the plate member to the apex 156 of the triangular support portion, although other configurations for a support member are also contemplated, such as a support wall which runs adjacent each side edge 120 and 122 of the plate member.

The invention has been described with reference to the preferred embodiments. It should be apparent that modifications and alterations will occur to others upon a reading and understanding of the preceding specification. It is intended that the invention be construed as including all such alterations and modifications insofar as they come within the scope of the appended claims or the equivalents thereof.

Having thus described the preferred embodiments, the invention is now claimed to be:

1. A shelf top adapter comprising:

a planar support member;

spaced rearward mounting fingers extending away from a rear edge of the support member for selectively engaging suitably shaped and positioned rearward apertures in an associated fixture;

spaced forward mounting fingers extending away from the support member forward of the rearward fingers for selectively engaging suitably shaped and positioned forward apertures in the associated fixture, the forward mounting fingers including resiliently flexible fins which extend laterally to the planar support member for engaging the lower surface of the associated fixture adjacent the forward apertures but flexing to allow removal of the adapter from the associated fixture; and a display member mounted on a forward end of the support member.

2. The shelf top adapter of claim 1, wherein the forward mounting fingers comprise pegs.

3. The shelf top adapter of claim 1, wherein the fins include camming surfaces for camming against edges of the forward apertures such that the forward fingers flex inward to allow the forward fingers to pass through the forward apertures.

4. The shelf top adapter of claim 1, further comprising two rigid support walls which extend from the planar support member and are connected with the display member.

5. The shelf top adapter of claim 1, wherein the display member includes a label mounting plate.

6. A shelf top adapter comprising:

a planar support member;

spaced rearward mounting fingers extending away from a rear edge of the support member for selectively engaging suitably shaped and positioned rearward apertures in an associated fixture;

spaced forward mounting fingers extending away from the support member forward of the rearward fingers, for selectively engaging suitably shaped and positioned forward apertures in the associated fixture; and, a label mounting plate attached by a rear face thereof to the forward end of the planar support member.

7. The shelf top adapter of claim 6, wherein the rearward mounting fingers extend rearwardly from the planar support member for engaging a lower surface of the associated fixture adjacent the rearward apertures.

8. The shelf top adapter of claim 6, wherein the label mounting plate is angled upwardly for ease of viewing from above.

9. The shelf top adapter of claim 6, wherein the label mounting plate includes an adhesive layer for attaching a label and a peelable strip which is removed prior to attaching the label.

10. The shelf top adapter of claim 6, further comprising a label holder which is attached to a front face of the label mounting plate for selectively receiving a label.

11. The shelf top adapter of claim 10, wherein the label holder is formed from a resiliently flexible transparent sheet which has been folded to form a channel for receiving the label.

12. The shelf top adapter of claim 6, wherein the label mounting plate extends downward from a forward end of the planar support member.

13. The shelf top adapter of claim 12, wherein the label mounting plate includes side facing surfaces for attaching labels thereto.

14. The shelf top adapter of claim 6, further comprising a package hook which extends from a lower end of the label mounting plate for displaying packages of merchandise.

15. A shelf top adapter comprising:

a support member having a rear edge and first and second side edges which together form a pair of spaced rear corners;

at least two spaced rearward feet extending downward and rearward from a respective one of said rear corners of the support member for selectively engaging suitably shaped and positioned rearward apertures in an associated fixture;

a forward mounting finger extending downward and laterally from each of the support member first and second side edges forward of the rearward feet, for selectively engaging suitably shaped and positioned forward apertures in an associated fixture; and, a display member extending from the support member forward of the forward mounting finger.

16. A shelf top adapter comprising:

a support member having a rear edge and first and second side edges;

at least one foot which extends downward and rearward from said rear edge of the support member adjacent said first side edge of the support member for selectively engaging a suitably shaped and positioned rearward aperture in an associated fixture;

at least one forward hook extending downward and laterally from adjacent said second side edge of the support member forward of the rear edge, for selectively engaging a suitably shaped and positioned forward aperture in an associated fixture; and, a display member extending from the support member forward of the hook.

17. A method of supporting a display member on a shelf, the method comprising:

angling a support member adjacent an upper surface of the shelf, the display member being connected with a forward end of the support member;

inserting a pair of spaced rearward feet of the support member into suitably positioned rearward apertures in the shelf such that an upward facing surface of each of the feet engages a lower surface of the shelf;

pivoting the forward end of the support member until a pair of spaced forward mounting fingers are received in suitably positioned forward apertures in the shelf, each of the forward mounting fingers comprising a hook having a laterally extending resiliently flexible fin, the step of pivoting including:

camming each of the fins against an outer edge of a corresponding one of the forward apertures such that the fin flexes and the hook enters the corresponding one of the forward apertures.

* * * * *